US007318683B2

(12) United States Patent
Byun

(10) Patent No.: US 7,318,683 B2
(45) Date of Patent: Jan. 15, 2008

(54) COSMETIC CASE

(76) Inventor: Young Kwang Byun, 928-1005, Mok-dong Apt. 312, Shinjeong-dong, Yangcheon-ku, Seoul 158-769 (KR)

( * ) Notice: Subject to any disclaimer, the term of this patent is extended or adjusted under 35 U.S.C. 154(b) by 17 days.

(21) Appl. No.: 11/344,086

(22) Filed: Feb. 1, 2006

(65) Prior Publication Data

US 2006/0171772 A1 Aug. 3, 2006

(30) Foreign Application Priority Data

Feb. 2, 2005 (KR) ..... 10-2005-0009752

(51) Int. Cl.
*A46B 11/04* (2006.01)
*A46B 11/00* (2006.01)
*B43K 5/12* (2006.01)

(52) U.S. Cl. ..... 401/281; 401/280; 401/286; 401/290; 401/194

(58) Field of Classification Search ..... 401/280, 401/281, 286, 290, 194
See application file for complete search history.

(56) References Cited

U.S. PATENT DOCUMENTS 2,425,474 A * 8/1947 Hussey ..... 401/180
2,529,036 A * 11/1950 Loewinsohn ..... 401/276
2,625,302 A * 1/1953 Mahoney ..... 222/82
2,827,650 A * 3/1958 Morrill et al. ..... 401/186

* cited by examiner

*Primary Examiner*—David J. Walczak
(74) *Attorney, Agent, or Firm*—Birch, Stewart, Kolasch & Birch, LLP

(57) ABSTRACT

A cosmetic case is structured such that a rotary body (3) having a brush (2) attached thereto is installed to rotate to the upper side of a tube-type case (1) for accommodating liquid cosmetic by an insertion body (4) such that the cosmetic case is manufactured by simple-structured components to enhance economic effect, an opening (12) and a discharge opening (9) are formed in the form of a single line in a body formed with the rotary body (3) such that the liquid cosmetic is smoothly discharged, lock checking parts (16 and 16a) are formed in the outer circumferential front sides of the tube-type case (1) and the insertion body (4) to easily check whether an opening (12) formed in the rotary body (3) and a liquid cosmetic discharging guide (6) formed in the upper side of the tube-type case (1) are opened or closed so that the liquid cosmetic does not leak and the cosmetic case can be maintained clean.

3 Claims, 4 Drawing Sheets

COSMETIC CASE

CROSS-REFERENCE TO RELATED APPLICATIONS

This application claims the benefit of Korean Patent Application No. 10-2005-0009752, filed on Feb. 2, 2005, in the Korean Intellectual Property Office, the disclosure of which is incorporated herein by reference.

BACKGROUND

1. Field of the Invention

The present invention relates to a cosmetic case comprising a container having a lock checking part formed in the front side of the outer circumference of the container for accommodating cosmetic; a guide hole for smoothly discharging liquid cosmetic; a plurality of insertion supporting walls formed in the upper side of the container; a rotary body coupled with the upper side of the container and having a discharge tube with a discharge passage, in which its lower end being inserted into the central portion of the rotary body and its upper end being inserted into the central portion of a brush and the discharge passage communicated with an opening formed downwardly within the rotary body; a brush placed above the upper side of the rotary body; and an insertion body inserted into the insertion supporting walls and having a lock checking part formed in the front side of the outer circumference of the insertion body such that the rotary body is safely coupled with the upper side of the container sufficient to allow a free rotation with respect to the container.

More particularly, the present invention provides a cosmetic case which has a simple structure, is easily manufactured and is safely used without fear of leakage of cosmetic by checking whether an opening through which the cosmetic is discharged is opened or closed using lock checking parts. Also, the present invention provides a cosmetic case, in which the cosmetic is smoothly discharged and it is convenient to use by placing a cosmetic discharge guide hole integrally formed with the case, an opening through which the cosmetic is discharged and a discharged tube with passage within a rotary body.

2. Discussion of Related Art

A conventional cosmetic case for discharging liquid cosmetic accommodated therein is structured such that an inlet has a slip prevention protrusion and male threads formed in the upper side of the case, a flange type packing having an insertion hole formed in the central portion thereof is inserted into the inlet, a guide groove having a central hole is formed in the upper side, a coupling ring having a locking groove is installed to a position controlling member having female threads and a slip prevention protrusion formed therein and the circumference of a shaft rod having a discharge hole formed in the upper side, a discharge opening communicated with the discharge hole of the shaft rod is formed in the lower side, and an embedding body, into which a brush is embedded by coupling a rotary body having a stopper and a guide protrusion, is inserted into a holder to forming an insertion groove in the lower circumference, and is inserted into an accommodating groove of a fixing member having a locking protrusion formed in the upper end. When using the cosmetic case, the packing and the position controlling member are fixed to the upper side of the case, the rotary body is rotated as long as the same distance as the size of the guide groove formed in the position controlling member such that the discharge opening as the lower end of the shaft rod installed in the upper side of the rotary body opens and closes the opening of the lower end of the insertion groove formed in the central portion of the packing to discharge and interrupt the liquid cosmetic accommodated in the case.

As described above, the conventional cosmetic case has a complicated structure and needs expensive manufacturing costs. Moreover, in the conventional cosmetic case, since there are so many components, labor costs for assembling the components are increased. When using the conventional cosmetic case, since the liquid cosmetic accommodated in the conventional cosmetic case passes through the opening of the insertion groove formed in the packing and is discharged through the discharge hole of the rotary body step by step, discharging the liquid cosmetic is interrupted in the multiple stage discharge line so that the liquid cosmetic cannot be smoothly discharged or sealing of the conventional cosmetic case is imperfect so that the liquid cosmetic is leaked during the carriage.

SUMMARY OF THE INVENTION

In order to solve the above-described problems, the present invention provides a cosmetic case in which a rotary body and a brush attached to the rotary body through an expanded insertion plate are installed to rotate with respect to the upper side of a tube-type case for accommodating liquid cosmetic by an insertion body such that the cosmetic case is manufactured by simple-structured components to enhance economic effect. The present invention also provides a cosmetic case in which an opening and a portion of discharge passage are formed within the rotary body such that the liquid cosmetic is smoothly discharged into the brush. Further, the present invention provides a cosmetic case in which lock checking parts are formed in the outer circumferential front sides of the tube-type case and of the insertion body to easily check whether an opening formed in the rotary body and a liquid cosmetic discharging guide hole in the upper side of the tube-type case are opened or closed so that the liquid cosmetic does not leak and the cosmetic case can be maintained clean.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Figure 1:
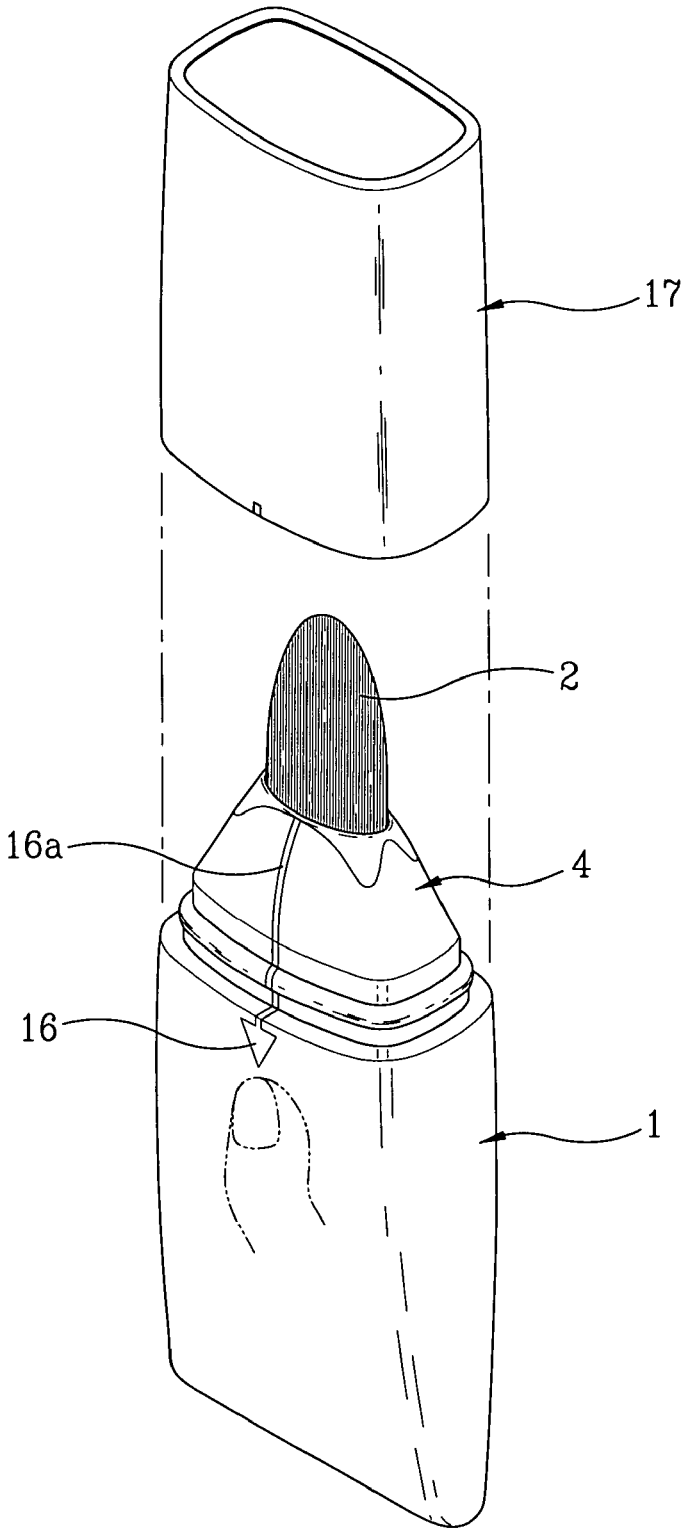
FIG. 1 is a perspective view of a cosmetic case according to the present invention.

A cosmetic case according to the preferred embodiment of the present invention includes a container 1 for accommodating liquid cosmetic and a brush 2 installed above the upper side of the container 1 to paint liquid cosmetic (to make-up). A rotary body 3 is installed in the upper side of the container 1 and a brush 2 is coupled with the upper side of the rotary body 4 through an insertion plate 14. A plurality of insertion supporting walls 5 is positioned around the upper side of the tube-type container 1. An insertion body 4 is inserted into the insertion walls 5 in a way that the body 4 is freely rotated with respect to the container 1. A pair of sealing bodies 7 are positioned in the central portion of the container 1, each being spaced from each other. An outwardly protruded wheel 7*a* is formed in the upper circumference of the sealing body 7 and a liquid cosmetic discharge guide 6 is protruded toward an inside wall of the sealing body 7. The brush 2 is positioned above an upper plate 8 of the rotary body 3. A discharge tube 10 having a liquid cosmetic discharging passage 9 is installed in a way that both ends of the tube 10 extends centrally between the rotary body 3 and the brush 2. A rotary body 3 comprises a longitudinal body 11 and an upper plate 8. The upper plate 8 has an inner recessive wheel 11*a* formed downwardly which is to be coupled with the outwardly protruded wheel 7*a* formed in the upper circumference of the sealing body 7. A body 11 integrally formed with the upper plate 8 is downwardly protruded toward the upper side of the container such that the rotary body 3 can be freely rotated within the sealing body 7 inserted into the central portion of the tube-type container 1. Within the lower side of the body 11, an opening 12 communicated with the liquid cosmetic discharging passage 9 is positioned either spaced from or communicated with the liquid cosmetic discharging guide 6 protruded toward an inside wall of the sealing body 7 to determine whether to discharge the liquid cosmetic. The insertion body 4 is designed to freely rotate by the insertion supporting walls 5 installed around the upper side of the tube-type container 1, wherein an insertion container 13 for accommodating the brush 2 is formed in the central portion of the insertion body 4 and the insertion plate 14 into which the upper plate 8 of the rotary body 3 is fitted, is extended at its both ends to be engaged with the clamping container 15, allowing the brush 2 to be fixed to the lower side of the insertion container 13.

When the tube-type container 1 and the outer circumferential front side of the insertion body 4 are coupled with each other, lock checking parts 16 and 16*a* are formed to check whether the liquid cosmetic discharging guide 6 and the opening 12 are communicated or not.

Reference numeral 17 indicates a lid coupled with the upper side of the container 1.

Figure 2:
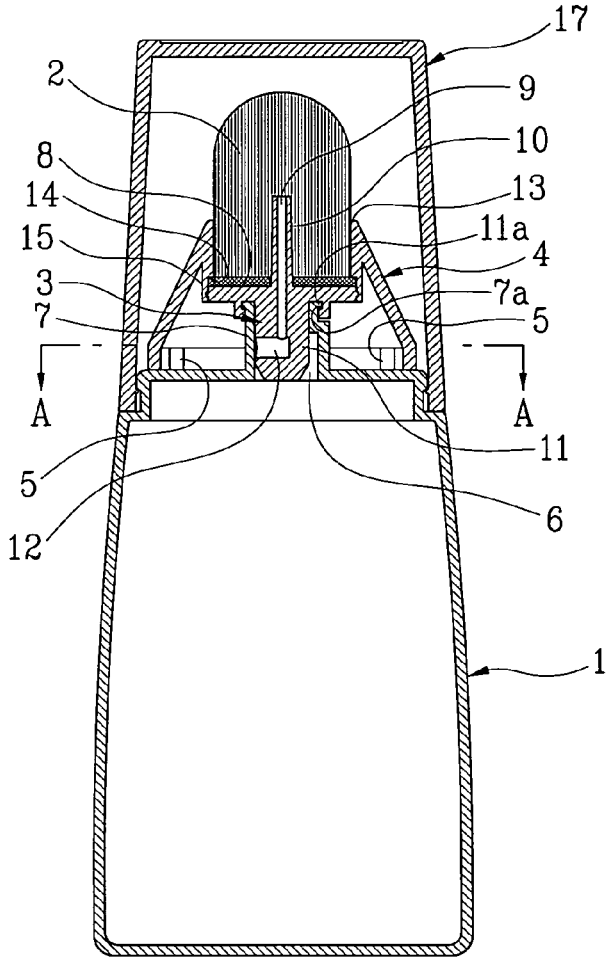
FIG. 2 is a front sectional view of the cosmetic case according to the present invention.
Figure 3:
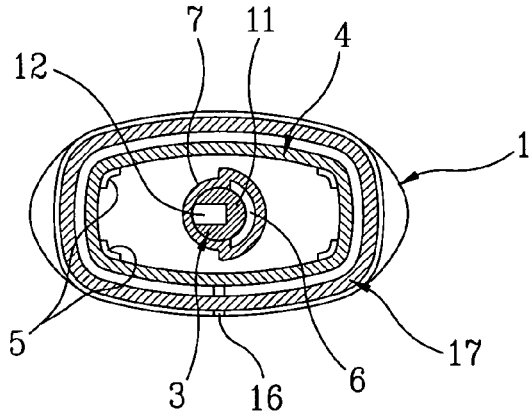
FIG. 3 is a sectional view taken along the line A-A in FIG. 2.

As described above, the cosmetic case according to the preferred embodiment of the present invention is structured such that the brush 2 is positioned above the upper side of the tube-type container 1, the body 11 of the rotary body 3 is installed to freely rotate, the rotary body 3 having the discharge tube 10 formed with the discharging passage 9 and the opening 12 are installed, and the insertion body 4 for clamping the rotary body 3 is installed to freely rotate. As shown in FIGS. 1 to 3, when the lock checking parts 16 and 16*a* formed in the outer circumferential front sides of the tube-type container 1 and of the insertion body 4 are aligned with each other in the vertical direction, the opening 12 of the body 11 installed in the sealing body 7 is positioned opposite to the liquid cosmetic discharging guide 6 protruded toward a side of the sealing body 7 and the opening is closed, the liquid cosmetic accommodated in the tube-type container 1 does not leak during carrying and keeping the cosmetic case.

Figure 4:
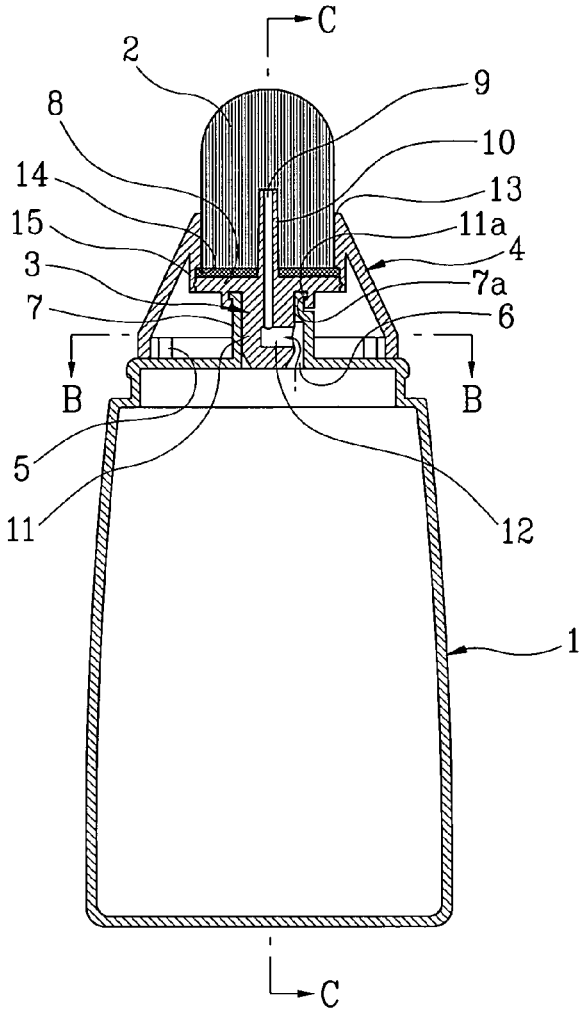
FIG. 4 is a longitudinal sectional view illustrating the discharge of liquid cosmetic in the cosmetic case according to the present invention.
Figure 5:
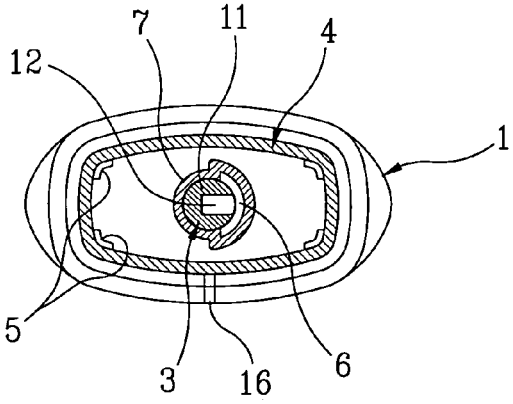
FIG. 5 is a sectional view taken along the line B-B in FIG. 4.
Figure 6:
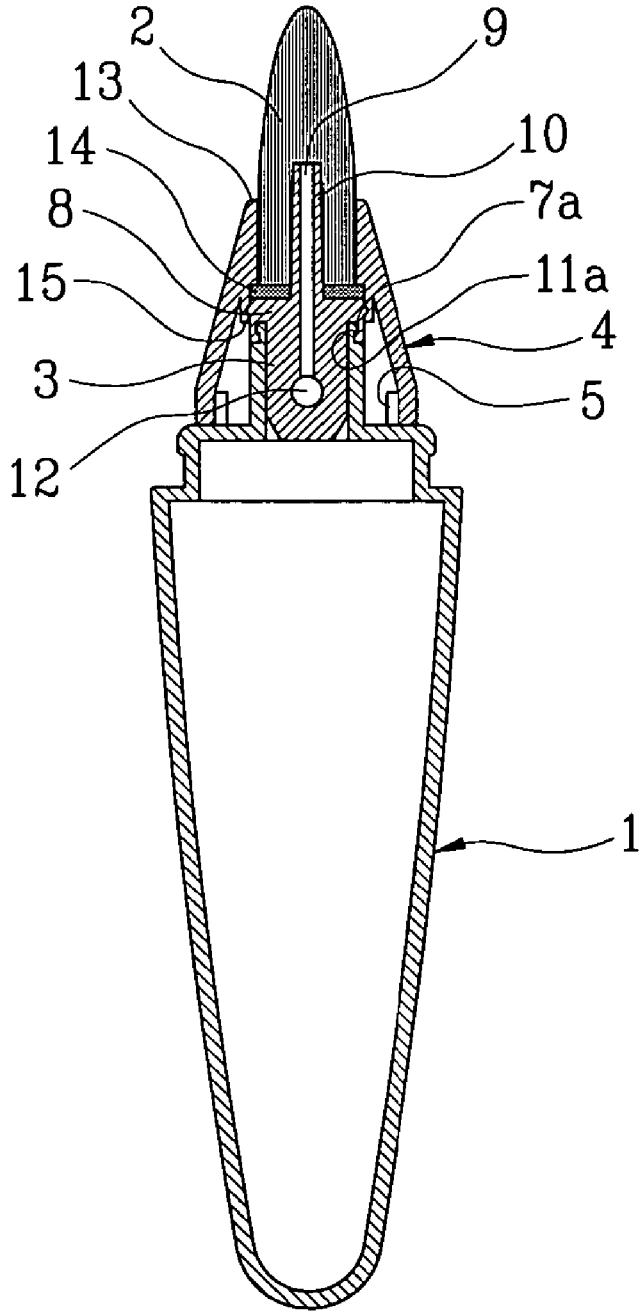
FIG. 6 is a sectional view taken along the line C-C in FIG. 4.

FIGS. 4 and 5 illustrate that the lock checking parts 16 and 16*a* of FIGS. 1 to 3 are aligned with each other in the vertical direction and the insertion body 4 is rotated by 180 degrees by holding and rotating the tube-type container 1 when the opening 12 is closed. In other words, the drawings illustrate an opened state that the opening 12 in the body 11 of the rotary body 3 communicated with the discharging passage 9 is communicated with the liquid cosmetic discharging guide 6, which is also communicated with the tube-type container 1 for accommodating the liquid cosmetic. As a result, the tube-type container 1 is properly pressed to discharge the liquid cosmetic accommodated in the tube-type container into the brush 2, which is attached to the rotary body 3 through the insertion plate 14.

When carrying and keeping the case as shown in FIGS. 1 to 3, the outwardly protruded wheel 7*a* of the sealing body 7 placed in the upper side of the tube-type container 1 is coupled with the inner recessive wheel 11*a* of the rotary body 3 and the body 3 is inserted into the insertion body 4 by a clamping container 15. The insertion body 4 is inserted into the insertion supporting walls 5 in a way that the insertion body 4 is freely rotate by 180 degrees, as shown in FIGS. 4 and 5. The upper leading end of the discharge tube 10 of the rotary body 3 is installed at a half level of the whole height of the brush 2 and the body 11 of the rotary body 3 is installed to freely rotate within the sealing body 7 positioned in the upper side of the tube-type container 1 such that the opening 12 communicated with the discharging passage 9 of the discharge tube 10 is communicated with the liquid cosmetic discharging guide 6 within the body 11. As a result, the discharging passage 9 and the tube-type container 1 are opened. At this time, the tube-type container 1 for accommodating the liquid cosmetic is pressed to discharge a proper amount of the liquid cosmetic such that the brush 2 is wet with the discharged liquid cosmetic and a user paints the cosmetic using the wet brush 2.

The liquid cosmetic accommodated in the tube-type container 1 is smoothly discharged through the opening 12 and the discharging passage 9 when the opening 12 is communicated with the liquid cosmetic discharging guide 6 within the body 11.

Moreover, since an upper leading end of the discharge tube 10 for forming the discharging passage 9 extends centrally to the middle height of the brush 2 where the liquid cosmetic is easily absorbed, the liquid cosmetic is smoothly discharged to the position where the brush 2 is convenient to use (to make-up) so that the user can easily make-up with the discharged liquid cosmetic.

After painting (making-up), the insertion body 4 installed in the upper side of the tube-type container 1 is rotated by 180 degrees such that, as shown in FIGS. 1 to 3, the lock checking parts 16 and 16*a* formed in the outer circumferential front sides of the tube-type container 1 and of the insertion body 4 are aligned with each other in the vertical direction. Thus, the opening 12 of the rotary body 3 is positioned opposite to the liquid cosmetic discharging guide 6 to close.

In this closed state, as described above, it is checked that the lock checking parts 16 and 16*a* formed in the outer circumferential front sides of the tube-type container 1 and of the insertion body 4 are aligned with each other in the vertical direction, and the proper amount of the liquid cosmetic such that the brush 2 is wet with the discharged liquid cosmetic and a user paints the cosmetic using the wet brush 2.

The liquid cosmetic accommodated in the tube-type container 1 is smoothly discharged through the opening 12 and the discharging passage 9 when the opening 12 is communicated with the liquid cosmetic discharging guide 6 within the body 11.

Moreover, since an upper leading end of the discharge tube 10 for forming the discharging passage 9 extends centrally to the middle height of the brush 2 where the liquid cosmetic is easily absorbed, the liquid cosmetic is smoothly discharged to the position where the brush 2 is convenient to use (to make-up) so that the user can easily make-up with the discharged liquid cosmetic.

After painting (making-up), the insertion body 4 installed in the upper side of the tube-type container 1 is rotated by 180 degrees such that, as shown in FIGS. 1 to 3, the lock checking parts 16 and 16*a* formed in the outer circumferential front sides of the tube-type container 1 and of the insertion body 4 are aligned with each other in the vertical direction. Thus, the opening 12 of the rotary body 3 is positioned opposite to the liquid cosmetic discharging guide 6 to close.

In this closed state, as described above, it is checked that the lock checking parts 16 and 16*a* formed in the outer circumferential front sides of the tube-type container 1 and of the insertion body 4 are aligned with each other in the vertical direction, and the lid 17 is coupled with the container 1 so that the cosmetic case is safely carried and kept without leakage of the liquid cosmetic.

As described above, the cosmetic case of the present invention has a simple structure, can be manufactured with a small number of components, can be easily assembled, and has a convenient structure for easily transforming from an opened positioned to a closed position by placing the discharge opening for discharging the liquid cosmetic and the liquid cosmetic discharging guide within the rotary body. When the upper leading end of the discharge tube for discharging the liquid cosmetic is positioned at the middle height of the central portion of the brush, which is the most preferable location for convenient use of the brush, the liquid cosmetic is smoothly discharged to easily paint the liquid cosmetic (to make-up). Since it can be easily checked that the lock checking parts formed in the outer circumferential front side of the tube-type container and the insertion body are aligned with each other in the vertical direction, the cosmetic case can be safely carried and kept without leakage of the liquid cosmetic.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A cosmetic case comprising a tube-type container, a brush positioned above the upper side of the tube-type container to discharge cosmetic, and a lid coupled with the upper side of the tube-type container, the cosmetic case comprising:

a structure having a sealing body positioned at the upper side of the tube-type container in which the sealing body forms an outwardly protruded wheel from the upper end of the sealing body and forms a liquid cosmetic discharging guide protruded toward an inside wall of the sealing body;

a rotary body having a longitudinal body and an upper plate, in which a discharge tube having a cosmetic discharging passage extends centrally between the rotary body and the brush, the brush is positioned above the circumference of the upper plate, an inner recessive wheel is formed in the lower side of the upper plate, the longitudinal body is downwardly protruded from the upper plate such that an opening is communicated with the discharging passage within the longitudinal body; and an insertion body having an insertion container in the central portion of the insertion body, in which the brush is inserted into the insertion container, and an insertion plate and a clamping container are formed to clamp the upper plate of the rotary body;

wherein the insertion body for accommodating the brush and clamping the rotary body is coupled with the upper side of the tube-type container sufficient to freely rotate with respect to the tube-type container.

2. The cosmetic case as claimed in claim 1, wherein an upper leading end of the discharge tube is positioned at the middle height of the brush.

3. The cosmetic case as claimed in claim 1, further comprising lock checking parts formed in the outer circumferential front sides of the tube-type container and of the insertion body.

* * * * *